United States Patent [19]

Shioya et al.

[11] 4,235,208

[45] Nov. 25, 1980

[54] EXHAUST GAS RECIRCULATION REGULATING SYSTEM

[75] Inventors: Toshio Shioya, Urawa; Kiyoshi Ishii, Tachikawa, both of Japan

[73] Assignee: Honda Giken Kogyo Kabushiki Kaisha, Tokyo, Japan

[21] Appl. No.: 43,001

[22] Filed: May 29, 1979

[30] Foreign Application Priority Data

Jun. 16, 1978 [JP] Japan ..... 53-72055

[51] Int. Cl.[3] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 3,739,797 | 6/1973 | Caldwell | 123/119 A |
| 3,779,222 | 12/1973 | Lorenz | 123/119 A |
| 3,818,880 | 6/1974 | Dawson et al. | 123/119 A |
| 3,884,200 | 5/1975 | Caldwell | 123/119 A |
| 3,915,136 | 10/1975 | Caldwell | 123/119 A |
| 3,926,161 | 12/1975 | Wertheimer | 123/119 A |
| 3,970,061 | 7/1976 | Caldwell | 123/119 A |
| 4,033,308 | 7/1977 | Hayashi et al. | 123/119 A |
| 4,111,172 | 9/1978 | Nishizawa et al. | 123/119 A |

FOREIGN PATENT DOCUMENTS

| | | | |
|---|---|---|---|
| 1486093 | 9/1977 | United Kingdom | 123/119 A |
| 1486651 | 9/1977 | United Kingdom | 123/119 A |

*Primary Examiner*—Wendell E. Burns

*Attorney, Agent, or Firm*—Lyon & Lyon

[57] ABSTRACT

A system for controlling introduction of gas into a passage of an internal combustion engine employs a first control valve in a gas introduction passageway, a second control valve in an air conduit connecting the intake passage to atmosphere, and a regulating valve responsive to vacuum intensity in the intake passage. The regulating valve actuates vacuum responsive actuators for the control valves. This system is used for recirculating exhaust gases into the intake passage. The regulating valve in combination with a restricted orifice for the actuator of the second control valve act to rapidly stop exhaust gas recirculation when the operator decelerates the engine.

7 Claims, 1 Drawing Figure

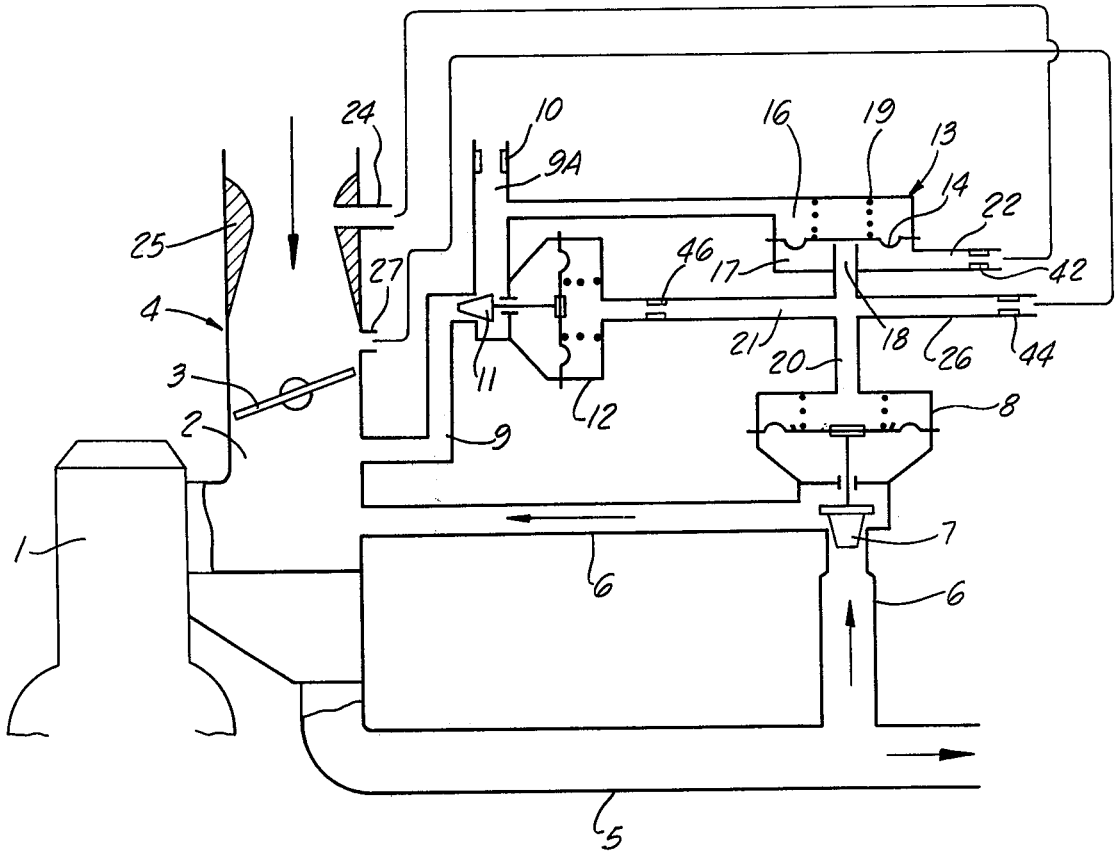
24
10
9A
16
19
13
14
22
25
27
46
17
42
4
3
2
11
12
21
20
18
26
44
8
9
1
7
6
6
5

EXHAUST GAS RECIRCULATION REGULATING SYSTEM

CROSS-REFERENCE

This application is related to co-pending and co-assigned U.S. patent application Ser. No. 9,370 filed Feb. 5, 1979 by Hirouki Nishimura, which is incorporated herein by this reference.

BACKGROUND

Exhaust gas recirculation systems are used in internal combustion engines to reduce air pollution problems. Exhaust gas is recirculated via a recirculation passageway to the intake passage an internal combustion engine to reduce generation of unwanted pollutants by the engine. Typically, a recirculation regulating valve is provided in the recirculation passageway. This valve controls the rate of recirculation in response to the vacuum generated by the engine in the intake passage.

One problem noted with such systems is that the regulating valve is unable to quickly shut off exhaust gas recirculation fully upon deceleration of the engine. This results in the combustion in the engine being unstable. This can result in a significant increase in the unburned hydrocarbon content of the exhaust gas.

Thus, there is a need for a exhaust gas recirculation regulating system designed to close the recirculation regulating valve immediately at when the operator decelerates the engine.

SUMMARY

The present invention is directed to such an exhaust gas recirculation regulating system. This system is for use in internal combustion engines having an intake passage with a throttle valve and an exhaust passage for carrying exhaust gases from the engine. The system comprises a passageway for passing exhaust gases from the exhaust passage to the intake passage. A first control valve is in said passageway. An air conduit is provided, for connecting the intake passage to the atmosphere. There is a second control valve in the air conduit, and each control valve has a vacuum response actuator. The actuators open their respective valves in response to opening of the throttle valve of the engine and close their respective valves in response to closing of the throttle valve.

A regulating valve responsive to vacuum intensity in the air conduit is provided for affecting vacuum intensity in the actuator for each of the control valves. Means are provided for causing the regulating valve to rapidly decrease the vacuum intensity in the actuator of the first control valve in response to closing of the throttle valve. This rapidly stops exhaust gas recirculation. The means for causing the regulating valve to rapidly decrease the vacuum intensity in the actuator preferably is a restricted orifice in a conduit between a vacuum chamber of the second control valve and the regulating valve. The restricted orifice slows the rate at which the vacuum decreases in the vacuum chamber of the second control valve, thereby interacting with the regulating valve to rapidly decrease the vacuum intensity in the actuator for the first control valve.

DRAWING

These and other features, aspects and advantages of the present invention will become better understood with reference to the accompanying drawing which shows in diagramatic form a side view of a preferred version of the present invention.

DESCRIPTION

Referring to the drawing, there is shown an internal combustion engine 1 having an intake passage 2 for an air-fuel mixture. A throttle valve 3 is positioned in this passage 2 downstream from a carburetor. The engine is also provided with an exhaust passage 5 for carrying exhaust gases away from the engine. A passageway 6 connects the exhaust passage 5 to the intake passage 2. A first control valve 7 controls the flow of exhaust gases from the exhaust passage 5 through the passageway 6 and into the intake passage 2. This first control valve 7 has a first vacuum responsive actuator 8.

A branched air conduit 9 connects the intake passage 2 with the atmosphere by way of an orifice 10. A second control valve 11 is positioned in the air conduit 9 to control flow of atmospheric air into the intake passage 2. This second control valve is provided with a second vacuum responsive actuator 12.

A regulating valve 13 is responsive, by means of a vacuum actuator such as a diaphragm 14 to two vacuum intensities. The first is the vacuum intensity in the portion 9A of the air conduit 9 between the second control valve 11 and the orifice 10. The second is the vacuum intensity in a first vacuum outlet 24 in a venturi portion 25 of the carburetor 4. The diaphragm 14 separates a first chamber 16 from a second chamber 17. The first chamber 16 communicates with the air conduit 9A and the second chamber 17 communicates with the first vacuum outlet 24. A valve port 18 opens into the second chamber 17 and it is closed by contact with the center portion of the diaphragm 14. The valve port 18 is controlled to be closed and opened to the second chamber 17 in accordance with pressure difference between the vacuum in the first chamber 16 and the vacuum in the second chamber 17. A supplemental spring 19 may be provided to adjust said pressure difference as occasion demands. The valve port 18 communicates with the vacuum responsive actuators 8 and 12 by way of tubes 20 and 21, respectively.

A tube 22, which has a restricted orifice 42 therein, connects the second chamber 17 to the first vacuum outlet 24 in the venturi portion 25 of the carburetor 4. A tube 26, which has a restricted orifice 44 therein, connects the vacuum responsive actuators 8 and 12 to a second vacuum outlet 27 located in the intake passage 2 in the vicinity of the throttle valve 3 upstream from the throttle valve 3 when it is closed. Means for restricting or reducing gas flow such as a restricted orifice 46 is provided in the tube 21 connecting the valve port 18 with the vacuum responsive actuator 12 of the second control valve 11.

In operation, the operating vacuum generated at the second vacuum outlet 27 in the intake passage 2 acts on the vacuum responsive actuators 8 and 12 to open the first and second control valves 7 and 11. Exhaust gases from the exhaust passage 5 are then circulated back to the intake passage 2. The vacuum intensity in the air conduit 9 between the second control valve 11 and the orifice 10 acts on the regulating valve 13 to cause the central portion of the diaphragm 14 to lift away from the valve port 18. Also the vacuum intensity in the first vacuum outlet 24 introduced into the second chamber 17 through the tube 22 acts on the regulating valve 13 to cause the diaphragm 14 to close the valve port 18. Thus, the action of the vacuum actuator 14 is regulated by means of both vacuum intensities in the air conduit 9A between the second control valve 11 and the orifice 10 and in the first vacuum outlet 24 in the venturi portion. As the vacuum intensity at the first vacuum outlet 24 increases, the regulating valve 13 closes and acts to raise the vacuum pressure in the vacuum responsive actuators 8 and 12, with the result that the rate of flow of exhaust gas circulation also increases.

From the foregoing description, it will be understood that the operating vacuum from the intake passage acting on a control valve is regulated by a regulating valve placed in a passageway connecting the intake passage to atmosphere. The regulating valve responds in proportion to the engine load and therefore the control of introduction of gas is accomplished in a direct manner. The first control valve and the second valve operate synchronously with each other so that by measuring the rate of flow through the orifice leading to atmosphere and selecting the flow characteristics of the second control valve on basis thereof, various rates of the additional gas flow introduced into an engine can be established.

The restricted orifice 46 in the tube 21 is responsible for rapid closure of the first control valve 7. This restricted orifice, which is right in front of the vacuum chamber of the second actuator 12, maintains the vacuum in this chamber for a short period of time during deceleration, i.e., it serves to decrease the rate at which the vacuum decreases in the vacuum chamber of the actuator 12. Because of this, the vacuum in the air conduit 9 between the orifice 10 and the second control valve 11 is greater than the vacuum at the first vacuum outlet 24 in the venturi portion of the carburetor, and during deceleration, the pressure at the first vacuum outlet 24 is close to atmospheric pressure.

This results in lifting of the diaphragm 14 from the valve port 18. This permits rapid leakage of air from the second chamber 17 of the regulating valve 13 via the valve port 18 and tube 20 into the vacuum chamber of the first vacuum responsive actuator 8. This results in rapid and complete closure of the first control valve 7 to quickly prevent recirculation of exhaust gas through the recirculation passageway 6.

It is evident from the foregoing that the present invention makes it possible to substantially immediately stop exhaust gas recirculation at deceleration of an engine to control the release of hydrocarbons from the engine and minimize the level of hydrocarbons in the exhaust. The construction and operation of this system is simple, but effective, because the leakage of air into the actuator of the recirculation gas control valve 7 is increased because of the presence of the restricted orifice 46 right in front of the vacuum chamber of the second vacuum control valve.

Although the present invention has been described in considerable detail with regard to certain versions thereof, other versions are possible. Therefore, the spirit and scope of appended claims should not be limited to the version described herein.

What is claimed is:

1. In an internal combustion engine having an intake passage with a throttle valve for delivering an air-fuel mixture into the engine and an exhaust passage for carrying exhaust gases from the engine, an exhaust gas recirculation system comprising (a) a passageway between the intake passage and the exhaust passage for passing exhaust gases from the exhaust passage to the intake passage;

(b) a first control valve in the passageway;

(c) an air conduit connecting the intake passage to atmosphere, a second control valve in the air conduit, each of the control valves having a vacuum response actuator for opening its respective valve in response to said opening of the throttle valve and closing the respective valve in response to closing of the throttle valve;

(d) a regulating valve responsive to vacuum intensity in the air conduit for affecting vacuum intensity in the actuator for each of the control valves; and (e) means for causing the regulating valve to rapidly decrease the vacuum intensity in the actuator for the first control valve in response to closing of the throttle valve for rapidly stopping exhaust gas recirculation.

2. The internal combustion engine of claim 1 in which the means for causing said regulating valve to rapidly decrease the vacuum intensity comprises a connecting conduit between a vacuum chamber of the second control valve and the regulating valve and means for restricting flow of gas in the connecting conduit.

3. The engine of claim 1 or 2 in which the regulating valve operates in response to the vacuum intensity of the air conduit and the vacuum intensity of a venturi portion of a carburetor.

4. In an internal combustion engine including a carburetor, an intake passage for delivering a gas-fuel mixture, the intake passage having a throttle valve, and an exhaust passage for carrying exhaust gases from the engine, an exhaust gas recirculation system comprising:

(a) an exhaust gas recirculation passageway between the exhaust passage and the intake passage;

(b) a first vacuum responsive control valve in the recirculation passageway, the first control valve having a vacuum chamber connected to a conduit in communication with a vacuum outlet of the intake passage in the vicinity of the throttle valve;

(c) a branched intake passageway connected to the intake passage at a location between the throttle valve and the engine, the branched passageway having a main branch and first and second side branches therefrom, the first side branch opening to the atmosphere;

(d) a second vacuum responsive control valve in the main branch, the second control valve having a vacuum chamber connected to the conduit;

(e) a vacuum actuator in the second branch, the vacuum actuator affecting the intensity of the vacuum in the vacuum chambers of the first and second control valves in response to the intensity of the vacuum in both the second side branch and a venturi portion of the carburetor, wherein when the throttle valve is closed, the vacuum actuator increases the rate at which vacuum decreases in the vacuum chamber of the first control valve for rapid closure of said gas recirculation passageway.

5. The engine of claim 4 including means for decreasing the rate at which vacuum decreases in the vacuum chamber of the second control valve.

6. The engine of claim 4 or 5 wherein the vacuum actuator comprises a diaphragm having first and second chambers on either side thereof, the first chamber being in communication with the second side branch, the second chamber being in communication with the venturi portion of the carburetor.

7. The engine of claim 6 including means for reducing gas flow between the vacuum chamber of the second control valve and the second chamber of the vacuum actuator.

* * * * *